US007743794B2

(12) United States Patent
Berger

(10) Patent No.: US 7,743,794 B2
(45) Date of Patent: Jun. 29, 2010

(54) SEAT BELT WEBBING, METHOD AND NARROW FABRIC NEEDLE LOOM FOR PRODUCTION OF SAME

(76) Inventor: Johann Berger, Obere Schlossstrasse 114, Alfdorf (DE) 73553

( * ) Notice: Subject to any disclaimer, the term of this patent is extended or adjusted under 35 U.S.C. 154(b) by 0 days.

(21) Appl. No.: 12/224,868

(22) PCT Filed: Mar. 8, 2007

(86) PCT No.: PCT/EP2007/002021

§ 371 (c)(1),
(2), (4) Date: Dec. 24, 2008

(87) PCT Pub. No.: WO2007/101692

PCT Pub. Date: Sep. 13, 2007

(65) Prior Publication Data

US 2009/0223587 A1 Sep. 10, 2009

(30) Foreign Application Priority Data

Mar. 8, 2006 (DE) ..... 10 2006 010 775

(51) Int. Cl.
*D03D 35/00* (2006.01)
*D03D 47/40* (2006.01)
*D03D 47/04* (2006.01)
*D03D 41/00* (2006.01)

(52) U.S. Cl. ..... 139/22; 139/432; 139/441; 139/442; 139/170.3; 139/195

(58) Field of Classification Search ..... 139/11, 139/20, 22, 23, 48, 50–53, 116.1, 431, 432, 139/440, 441, 442, 170.3, 170.7, 195
See application file for complete search history.

(56) References Cited

U.S. PATENT DOCUMENTS 2,672,163 A * 3/1954 Walters ..... 139/116.1
3,064,689 A * 11/1962 Piazzolla et al. ..... 139/432
3,156,265 A * 11/1964 Bustamante ..... 139/11
3,446,249 A * 5/1969 Wellman ..... 139/11
3,456,692 A 7/1969 Kronoff
3,460,583 A 8/1969 Mosher
3,519,029 A * 7/1970 Piazzolla et al. ..... 139/431
3,580,295 A * 5/1971 Jisa et al. ..... 139/383 R
3,752,195 A * 8/1973 Libby ..... 139/431
3,811,479 A * 5/1974 Gardella ..... 139/431
3,859,156 A * 1/1975 Yazawa et al. ..... 156/265
3,996,971 A 12/1976 Griffith et al.
4,174,738 A * 11/1979 Berger et al. ..... 139/384 R
4,202,381 A * 5/1980 Bucher ..... 139/383 R
4,313,473 A * 2/1982 Reiter ..... 139/432
4,344,463 A * 8/1982 Muller et al. ..... 139/383 R
4,441,530 A * 4/1984 Bucher ..... 139/432
4,502,513 A * 3/1985 Müeller ..... 139/383 R
4,531,554 A * 7/1985 Muller et al. ..... 139/116.1
4,577,665 A * 3/1986 Diesner ..... 139/431
4,660,605 A 4/1987 Koch
4,981,161 A * 1/1991 Pickering et al. ..... 139/383 R
5,167,263 A * 12/1992 Kelen et al. ..... 139/383 R (Continued)

FOREIGN PATENT DOCUMENTS

DE 2 719 382 11/1978

(Continued)

*Primary Examiner*—Bobby H Muromoto, Jr.
(74) *Attorney, Agent, or Firm*—Harness, Dickey & Pierce, P.L.C.

(57) ABSTRACT

The invention relates to a method for weaving a webbing, comprising at least one first (right-hand) weft thread and at least one second (left-hand) weft thread, characterized in that the two weft threads are introduced into the same shed from both sides of the webbing, are wound around weft thread retainers in weft change loops, are substantially retained by the weft thread retainers until shed change and are then stripped off from the left thread retainers by the reed and after shed change and are bound against the stop.

24 Claims, 12 Drawing Sheets

U.S. PATENT DOCUMENTS

| | | | | |
|---|---|---|---|---|
| 5,224,519 | A * | 7/1993 | Farley | 139/11 |
| 5,299,603 | A * | 4/1994 | Reiter | 139/431 |
| 5,769,130 | A * | 6/1998 | Brielmann | 139/22 |
| 5,909,750 | A * | 6/1999 | Sanders | 139/11 |
| 6,007,092 | A | 12/1999 | Martz | |
| 6,112,775 | A * | 9/2000 | Hossli et al. | 139/383 R |
| 6,199,597 | B1 * | 3/2001 | David | 139/383 R |
| 6,705,244 | B1 | 3/2004 | Berger et al. | |
| 6,883,557 | B1 | 4/2005 | Eschbach et al. | |
| 6,918,411 | B2 * | 7/2005 | Berger et al. | 139/434 |
| 7,121,306 | B2 * | 10/2006 | Harrison | 139/440 |
| 7,178,559 | B2 * | 2/2007 | Tielemans et al. | 139/117 |
| 7,380,573 | B2 * | 6/2008 | Reiter | 139/447 |
| 2002/0112771 | A1 * | 8/2002 | Waldrop et al. | 139/50 |
| 2002/0189701 | A1 * | 12/2002 | Berger et al. | 139/383 R |
| 2008/0214346 | A1 * | 9/2008 | Westerkamp et al. | 474/267 |
| 2009/0223587 | A1 * | 9/2009 | Berger | 139/11 |

FOREIGN PATENT DOCUMENTS

| | | | |
|---|---|---|---|
| DE | 3 345 508 | | 6/1985 |
| GB | 652 552 | A | 4/1951 |
| GB | 960 878 | A | 6/1964 |
| GB | 1 243 354 | A | 8/1971 |
| GB | 1 245 046 | A | 9/1971 |
| WO | WO-91/14814 | A | 10/1991 |

* cited by examiner

Fig. 14
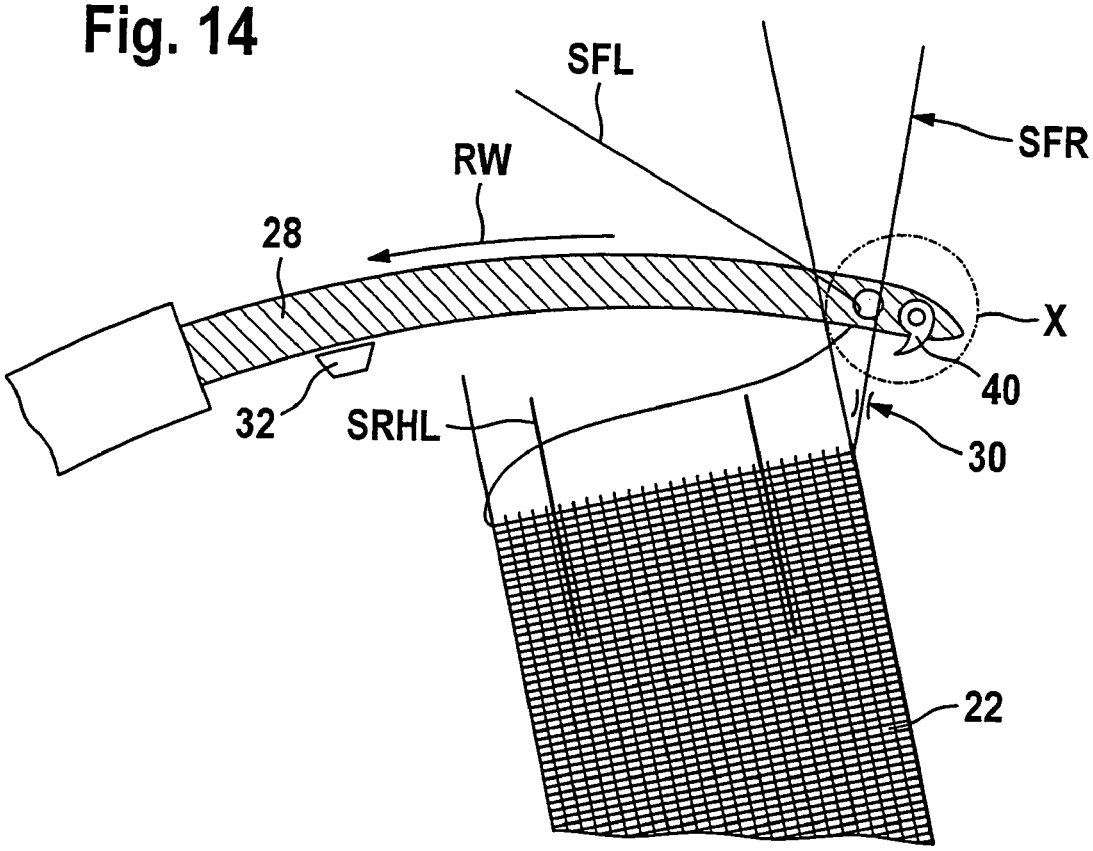
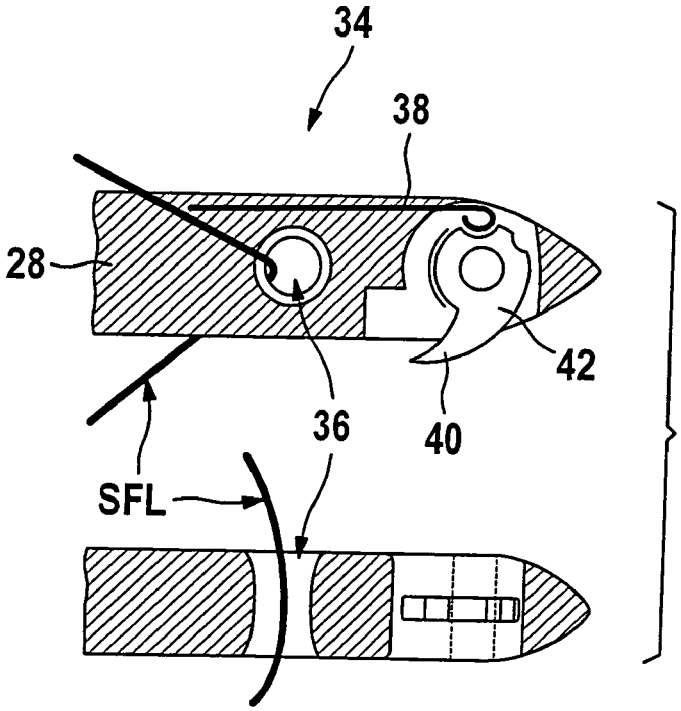
Fig. 15

SEAT BELT WEBBING, METHOD AND NARROW FABRIC NEEDLE LOOM FOR PRODUCTION OF SAME

CROSS-REFERENCE TO RELATED APPLICATIONS

This is a National Phase entry of PCT/EP2007/002021, filed Mar. 8, 2007, which claims priority to German Application No. 10 2006 010 775.6, filed Mar. 8, 2006, both of which are incorporated by reference herein.

BACKGROUND AND SUMMARY

The present invention relates to a method for weaving a webbing comprising a right-hand weft thread (SFR) and a left-hand weft thread (SFL), it also relating to a narrow fabric needle loom.

Known from DE 27 19 382 C3 (Berger) is weaving a single-ply seat belt webbing having tubular selvedges on a narrow fabric needle loom by a sole weft needle. One of two single-ply woven edge portions is pulled up to the selvedge of the middle portion to form the one tubular selvedge by pulling the weft thread.

Known from CH 648 069 A5 (Berger) is a webbing particularly for automotive seat belts made on a narrow fabric needle loom. The webbing features a relatively stiff middle portion and soft edge portions formed into tubular selvedges. To speed up production two weft needles are provided working simultaneously in parallel, the one picking a soft weft thread in the middle portion and the two edge portions, the other picking a stiffer weft thread in just the middle portion and picking only the two outermost warp threads of the two edge portions. Two weft needles pick simultaneously two different weft materials into partly different shed openings. The two flat edge portions are drawn into tubular selvedges by the one weft thread picked only via the middle portion. The middle portion is reinforced to achieve a higher performance. The aim was to double the output by using two weft needles as compared to single needle systems. However, the larger mass and the needed larger and faster movements of the auxiliary pickers resulting from the two weft needles only made it possible to achieve much less than twice the output.

Known from DE 33 45 508 C2 (leperband) is a webbing (safety belt) woven single-ply, likewise making use of two weft needles simultaneously to pick two different weft yarns. A monofil weft thread merely serves to reinforce the middle portion and must not be used to pull over the flat edge portions. By current standards these known webbings and methods of their production are too costly and have since ceased to satisfy the increasing demands of the automotive industry. What has particularly increased are the demands on webbing having comfortable soft edge portions whilst the inner portion is required to feature maximized transverse stiffness. On top of this, these known devices for producing webbing are very complicated and difficult to master in operation.

It is thus the object of the present invention to propose a webbing, a method and a narrow fabric needle loom of the aforementioned kind which now avoids or at least greatly minimizes the drawbacks of prior art. This object is achieved by a method as set forth in claim 1, namely a method for weaving a webbing comprising a right-hand weft thread and a left-hand weft thread, characterized in that the two weft threads are picked into the same shed from both sides of the seat belt webbing, are wound around weft holdbacks in weft reversal loops, are substantially retained by the weft holdbacks until beat by the reed against the fell, it not being until then that a shed change is made. This technique in accordance with the invention results in two weft threads each coming simultaneously from the right-hand and left-hand weft picking side being picked practically symmetrically transversely over the webbing where they are each held back at the opposite side by a separate weft holdback provided there, after which the weft needles are retracted to their side thereby entraining the weft thread and holding it taut until the reed has beaten up the freshly picked weft threads to the already woven webbing material, the weft threads being held back up to this point in time by the weft holdbacks being set by the advanced shed change.

In this arrangement the webbing is advantageously produced without any need of tucking or crotchet, tonque or pusher needles whatsoever and also without any meshing or crotcheting of the weft thread being needed. These weaving devices as standard on more complicated means of prior art can now all be eliminated by application of the method in accordance with the invention. Merely weft holdbacks in contact with the usual control of catch needle holders are still needed.

An advantageous further embodiment of the method in accordance with the invention for weaving a seat belt webbing comprising an inner portion, a preferably soft right-hand edge portion and a preferably soft left-hand edge portion, is characterized by a continuous repeat of a first step sequence;

ar) picking the right-hand weft thread from the right-hand side of the webbing into the right-hand edge portion and into the inner portion by means of a right-hand weft needle, al) picking the left-hand weft thread from the left-hand side of the seat belt webbing into the left-hand edge portion and into the inner portion by means of a left-hand weft needle simultaneously to step ar), br) retaining the right-hand weft thread in the transition portion from the inner portion to the left-hand edge portion by means of a left-hand weft holdback, bl) retaining the left-hand weft thread in the transition portion from the inner portion to the right-hand edge portion by means of a right-hand weft holdback simultaneously to step br), cr) tucking the right-hand weft thread with the left-hand weft holdback and returning the left-hand weft holdback to the fell, cl) tucking the left-hand weft thread with the right-hand weft holdback and returning the right-hand weft holdback to the fell simultaneously to step cr), dr) returning the right-hand weft needle to the right-hand side of the seat belt webbing, dl) returning the left-hand weft needle to the left-hand side of the seat belt webbing simultaneously to step cr), e) stripping off the weft loops formed in the previous step from the two weft holdbacks by the reed to the fell and forwarding the two weft holdbacks away from the fell, f) beating the two weft threads by a reed.

The method is advantageously characterized in that two weft needles guiding the weft threads each coming from the right and left weft picking side respectively pick the weft threads simultaneously and practically symmetrically transversely over the webbing, each of which is held back on the opposite side in the transition between the inner portion and edge portion by the weft holdback element located there in each case, after which the weft needles are returned to their side entraining and tensioning the weft threads tensioned until the reed beats up the newly inserted weft threads to the already woven webbing material. Up until this point in time the weft threads held back by the weft holdbacks are beat up and set by the following shed change.

In application of the method in accordance with the invention as it reads from claim 2 both weft threads are arranged in the inner portion, and only one in each case being in the edge portion belonging to its weft thread picking side. This results in the advantage that each edge portion is occupied only with one weft thread and is thus softer, whilst the two weft threads in the inner portion endow it with a higher transverse stiffness due to twice the proportion of material as compared to the edge portions.

Another advantageous further embodiment of the method for weaving a seat belt webbing whose right and left-hand weft threads are hybrid threads is characterized by the following step implemented after weaving: thermosetting the seat belt webbing. Used as weft threads in this arrangement are hybrid threads as are converted after weaving by said thermosetting into monofil-type structures in endowing the seat belt webbing in accordance with the invention with additional monofil qualities adequately for transverse stiffness without making use of actual monofil threads. Hybrid threads are threads made of materials having different melting temperatures as are known from prior art. The advantage in this is that after weaving such hybrid threads as weft threads, as claimed herein, the hybrid threads can be solidified into a monofil condition by subjecting them to thermosetting after weaving, resulting in the components of the hybrid threads having a low melting point to melt embedding the components having a higher melting point into monofil type structures featuring enhanced flexibility, transverse stiffness and as termed with seat belt webbing, rebound transversely to the webbing.

A further advantageous aspect of the method in accordance with the invention is the use an additional left-hand weft needle for picking a monofil weft needle supplied in the transition between the left-hand edge portion and the inner portion, the monofil weft needle being held secure on both sides in addition to the just mentioned weft threads likewise by the weft holdbacks resulting in the monofil weft threads being woven only in the inner portion. This is characterized by the following further steps:

az) picking a monofil weft thread fed preferably in the transition portion from the inner portion to the left-hand edge portion from left to right up to the transition portion from the inner portion to the right-hand edge portion by means of a supplementary weft needle simultaneously to step ar)

bz) retaining the monofil weft thread in the transition portion from the inner portion to the right-hand edge portion by means of the right-hand weft holdback simultaneously to step cr), cz) tucking the monofil weft thread with the right-hand weft holdback and returning the right-hand weft holdback up to just before the fell simultaneously to the step cr)

dz) returning the supplementary weft needle simultaneously to step dr).

Catching, releasing and beating the monofil weft thread is done analogous to the actions as already described relating to the weft threads as described above, for which, as explained further on in the description, an additional weft needle is employed. The supplementary monofil weft thread additionally incorporated in the inner portion in accordance with the invention results in the advantage that the seat belt webbing now features enhanced transverse stiffness in the inner portion whilst the edge portions remain soft as wanted.

A further advantageous embodiment of the method in accordance with the invention for weaving a webbing is characterized by the following second sequence in the steps optionally alternated with the first sequence of steps as it reads from claim 2 for optionally forming picots at the selvedges of the webbing:

apr) picking the right-hand weft thread from the right-hand side of the webbing over the full webbing width beyond the left-hand webbing side by means of a right-hand weft needle), apl) picking the left-hand weft thread from the left-hand side of the webbing over the full webbing width beyond the right-hand webbing side by means of a left-hand weft needle, simultaneously to step apr), bpr) retaining the right-hand weft thread outside of the webbing adjoining the left-hand edge portion by means of a second left-hand weft holdback in forming weft loops, bpl) retaining the left-hand weft thread outside of the webbing adjoining the right-hand edge portion by means of a second right-hand weft holdback in forming weft loops simultaneously to step bpr), dr) returning the right-hand weft needle to the right-hand side of the seat belt webbing, dl) returning the left-hand weft needle to the left-hand side of the seat belt webbing simultaneously to step dr), ep) stripping off the weft loops formed in the steps bpr) and bpl) from the two weft holdbacks, f) beating the two weft threads by a reed.

This now makes it possible to produce webbing with weft loops or so-called picots optionally included to protrude beyond the selvedge which is particularly favorable in the production of ribbons and braids, mainly for ready-to wear garments. Involved in this is also a further advantageous embodiment of the method in accordance with the invention which is characterized by elastic warp threads being made use of.

In another advantageous further embodiment of the method in accordance with the invention multifil threads are employed as weft threads to guarantee a soft selvedge. As a rule multifil threads are also employed as warp threads for seat belt webbing, resulting in the wanted soft selvedge of advantage in the edge portions. In another advantageous further embodiment of the method in accordance with the invention elastic threads are employed. This now makes it possible to produce elastic webbings for ready-to wear garments.

The object is furthermore achieved by a narrow fabric needle loom as it reads from claim 9 featuring a right-hand weft needle and a left-hand weft needle configured controllably simultaneously to each other, as well as a right-hand and a left-hand weft holdback for retaining and releasing the left-hand and right-hand weft thread respectively, and also being configured to work coordinated to each other, particularly working simultaneously with each other, and a reed. In a further advantageous aspect of the invention the narrow fabric needle loom is characterized in that the weft holdbacks are fixedly secured to the loom and that an elastic arrangement of stripper/holder wires is provided oriented preferably slightly towards the fell suitable for stripping off the weft thread loops before the shed change and before the fell from the weft holdbacks and retaining same by urging them to the fell until the reed itself beats up the weft threads. In this arrangement the narrow fabric needle loom in accordance with the invention may be additionally characterized in that the weft holdbacks are configured vertically pliant so that they are easily lifted by the tensioned weft threads in facilitating the sliding down of the weft threads.

With the narrow fabric needle loom in accordance with the invention the method in accordance with the invention for producing a seat belt webbing in accordance with the invention fabrication is now much simpler and with less wear and tear as is known in prior art. No catchment threads and no blocking threads now being needed to produce soft edges, this also eliminating the need for all of the equipment needed for this purpose in prior art. This greatly simplifies producing the seat belt webbing as compared to methods and devices as known from prior art. When employing hybrid threads as the weft threads thermosetting is done after weaving which, however, adds nothing to costs of the method as compared to prior art since any seat belt webbing, even when not made of hybrid weft threads, requires thermosetting to endow the seat belt webbing with the necessary shrinkage and stretch together with the wanted buffer for stretching thereof. Further advantages and features read from the sub-claims.

BRIEF DESCRIPTION OF THE DRAWINGS

For a better appreciation of the invention it will now be explained by way of two example aspects with reference to the drawings in which:

FIG. 14 is a diagrammatic partial section view of a further example aspect of a device in accordance with the invention having a weft needle for two weft threads including an eyelet and a tucker.

FIG. 15 is a diagrammatic partial section view of a magnified detail X as shown in FIG. 14 from the side and in a top-down view.

DETAILED DESCRIPTION

Figure 1:
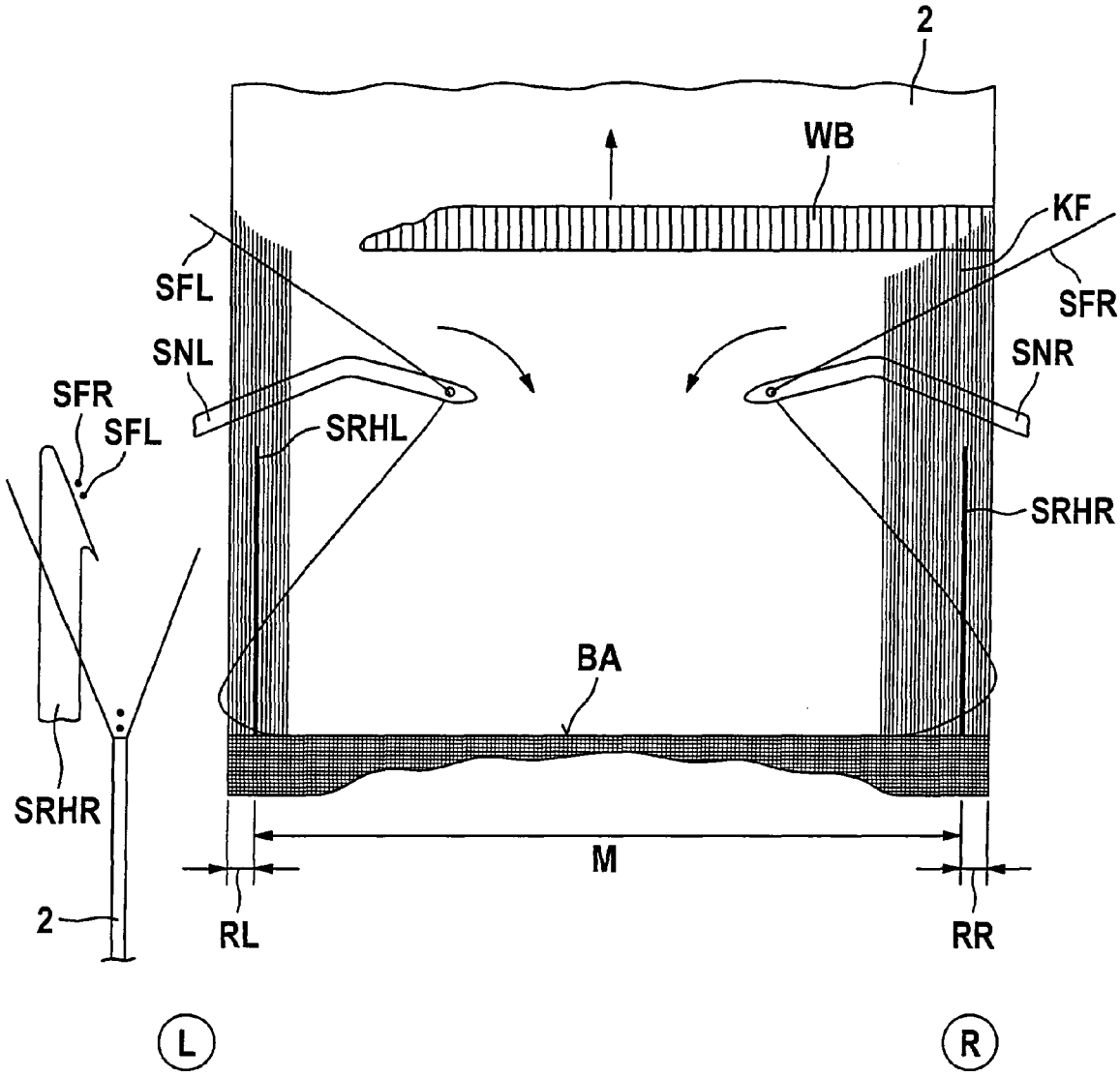
FIG. 1 is a diagrammatic, greatly magnified view of a seat belt webbing and salient parts of a narrow fabric needle loom as shown during a first step in the process in which the weft needles have entered the shed roughly by a third.

Referring now to FIG. 1 there is illustrated a seat belt webbing 2 the right and left-hand sides of which correspond to the right and left-hand sides of the drawing in accordance with the capital letters R and L evident encircled below FIG. 1. This applies to all figures as discussed in the following. The seat belt webbing 2 is divided into three portions, a left-hand edge portion RL, an inner portion M and a right-hand edge portion RR. Arranged in each transition portion between the left-hand edge portion RL and inner portion M and between the inner portion M and the right-hand edge portion RR are so-called weft holdbacks SRHR (right-hand) and SRHL (left-hand) evident from FIGS. 2 and 3 by their retaining point symbolized by a thick, black dot. These retaining points are the auxiliary holdback points which by their function lead to each weft reversal points opposite the weft picking side which are located within the material of the seat belt webbing in accordance with the invention and thus "disappear". Outside of these weft holdback positions simply the soft selvedge exists, indicated simply by a weft thread.

Figure 2:
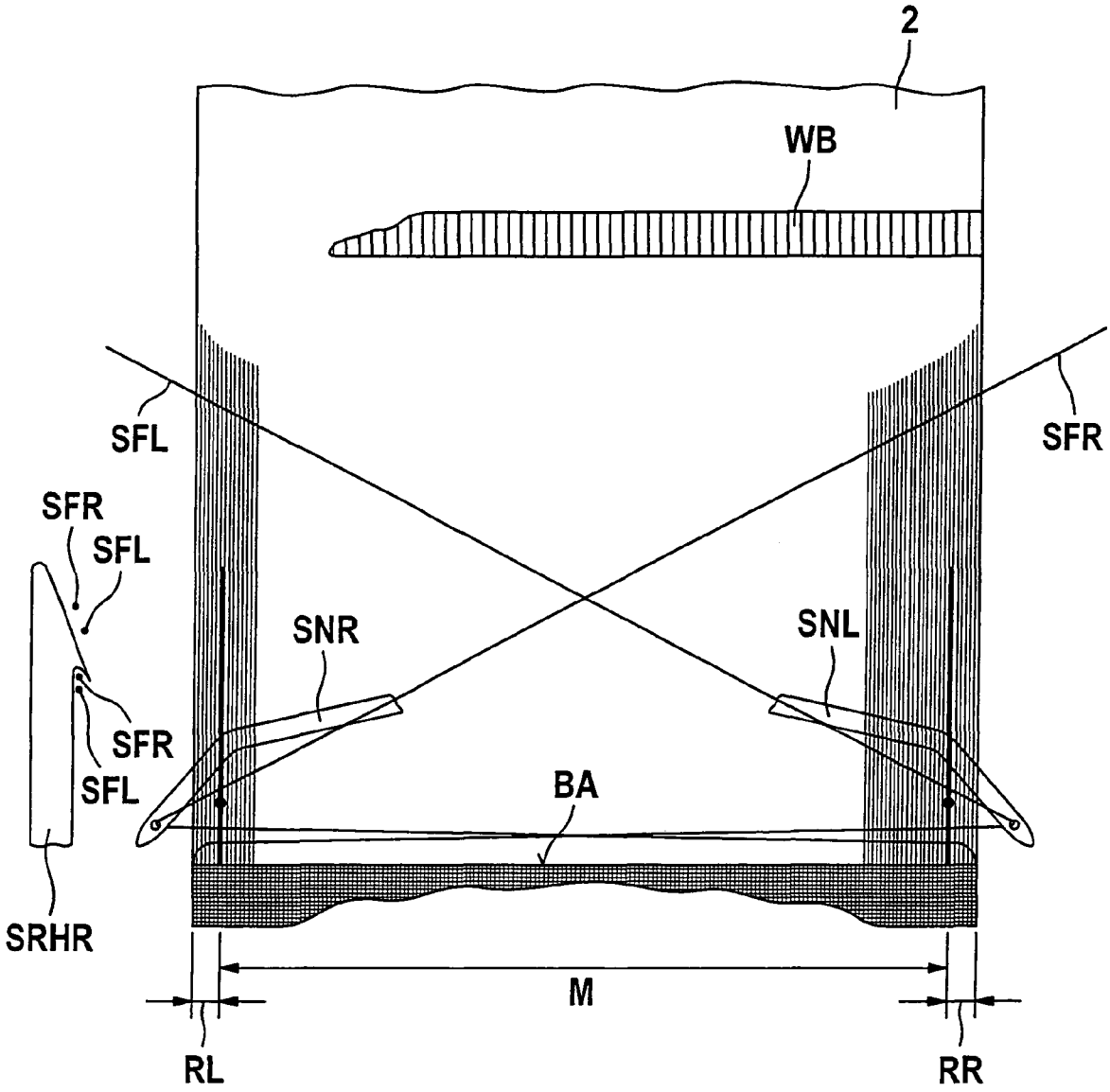
FIG. 2 is a diagrammatic, greatly magnified view of a seat belt webbing and parts of a narrow fabric needle loom as shown during a second step in the process in which the weft needles are fully retracted.
Figure 3:
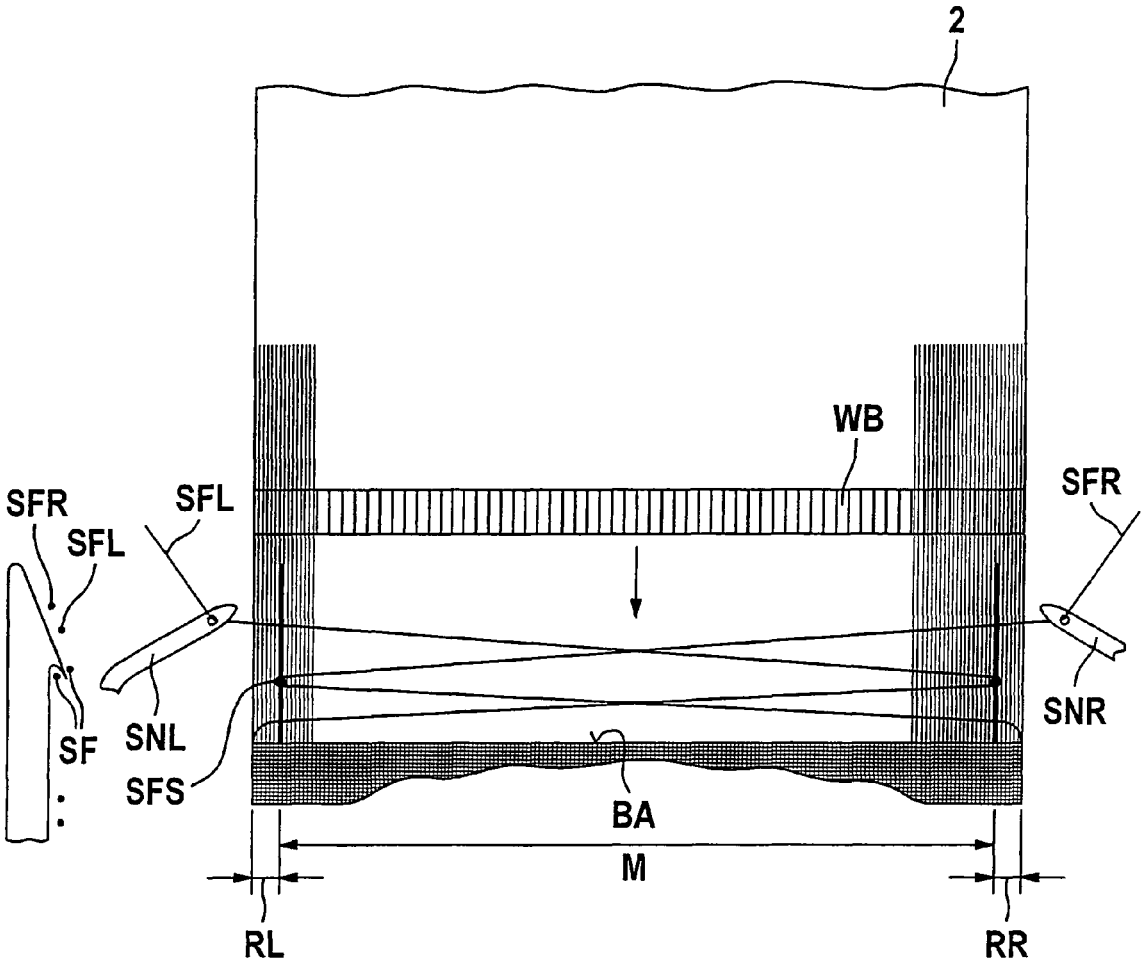
FIG. 3 is a diagrammatic, greatly magnified view of a seat belt webbing and parts of a narrow fabric needle loom as shown during a third step in the process in which the reed is just before the fell with the weft needles (again) fully retracted.

The situation as shown in FIG. 1 shows the weft needles SNL, SNR extended roughly by a third into the shed, whilst FIG. 2 already shows the final position of the weft needles in the fully picked position. By contrast, FIG. 3 shows the opposite situation with the weft needles SNL and SNR fully retracted and also the weft reversal points formed by the weft holdback function at the selvedge of the inner portion. It is evident from FIG. 3 how the reed WB is already advanced nearer to the picking zone which in the next step is advanced to the freshly picked weft threads as indicated by the arrow to be beaten up by the material indicated shaded as already being woven. In this arrangement the weft holdbacks briefly lose their function whilst the weft reversal positions are likewise removed therefrom. Shown in the figures, particularly in FIG. 1, by way of example, on the right-hand side is a weft holdback SRHR in the shape of a sawtooth. In FIG. 1 the two weft threads SFR and SFL are shown as dots cross-sectionally just before being shifted by the motion of the weft needles onto the weft holdback SRHR in thus attaining the position as shown in FIG. 2 (right-hand side). Evident already from FIG. 3 (right-hand side) is the condition of the weft holdback SRHR in which the weft threads have been removed therefrom and bound to the material by the further action of the reed.

The method in accordance with the invention for weaving a seat belt webbing comprising an inner portion M, a soft right-hand edge portion RR and a soft left-hand edge portion RL, a right-hand weft thread SFR and a left-hand weft thread SFL, functions as a continuous repeat of a step sequence;

ar) picking the right-hand weft thread SFR from the right-hand side of the webbing into the right-hand edge portion RR and into the inner portion M by means of a right-hand weft needle SNR, al) picking the left-hand weft thread SFL from the left-hand side of the webbing into the left-hand edge portion RL and into the inner portion M by means of a left-hand weft needle SNL simultaneously to step ar), br) retaining the right-hand weft thread SFR in the transition portion from the inner portion M to the left-hand edge portion RL by means of a left-hand weft holdback SRHL, bl) retaining the left-hand weft thread SFL in the transition portion from the inner portion M to the right-hand edge portion RR by means of a right-hand weft holdback SRHR simultaneously to step br), cr) tucking the right-hand weft thread SFR with the left-hand weft holdback SRHL and returning the left-hand weft holdback SRHL into the vicinity of the fell BA, cl) tucking the left-hand weft thread SFL with the right-hand weft holdback SRHR and returning the right-hand weft holdback SRHR into the vicinity of the fell BA simultaneously to step cr), dr) returning the right-hand weft needle SNR to the right-hand side of the webbing, dl) returning the left-hand weft needle SNL to the left-hand side of the webbing simultaneously to step cr), e) stripping off the weft loops formed in the previous step from the two weft holdbacks SRHR, SHRL by the reed WB to the fell BA and forwarding the two weft holdbacks SRHR, SHRL away from the fell BA, f) beating up the two weft threads SFR, SFL by the reed (WB).

In steps cr) to e) the weft holdbacks are shuttled on a slight curve, in the forwards motion—away from the fell—the weft threads advanced by the weft needles slide down into place behind the angled upright hook tips into the gussets of the hooks of the weft holdbacks. In the backwards motion the holdbacks SRHL, SRHR move back, the weft needles SNL, SNR also being retracted, whereas the weft thread loops SFS remain hanging on the hooks. After shed closure the reed WB is forwarded, stripping off the weft thread loops and urging them to the fell (see also FIGS. 1 to 6).

When strongly reducing the inner portion in its width M, resulting in just a slim strip, whilst simultaneously strongly widening the edge portions RR, RL a webbing materializes totally different from that as described hitherto whose inner portion has the appearance of a thickened ridge. To offset any stresses having occurred the portions can be woven differently, e.g. a plain 1/1 weave in the edge portions and panama 2/2 in the inner portion. Webbings can be produced highly cost-effectively to advantage even with a large overall width. Since the person skilled in the art is aware of how a narrow fabric needle loom works, details thereof are omitted in the following description. The main components of the seat belt webbing 2 in accordance with the invention namely warp threads KF and the weft threads SFR and SHL are clearly evident.

Figure 4:
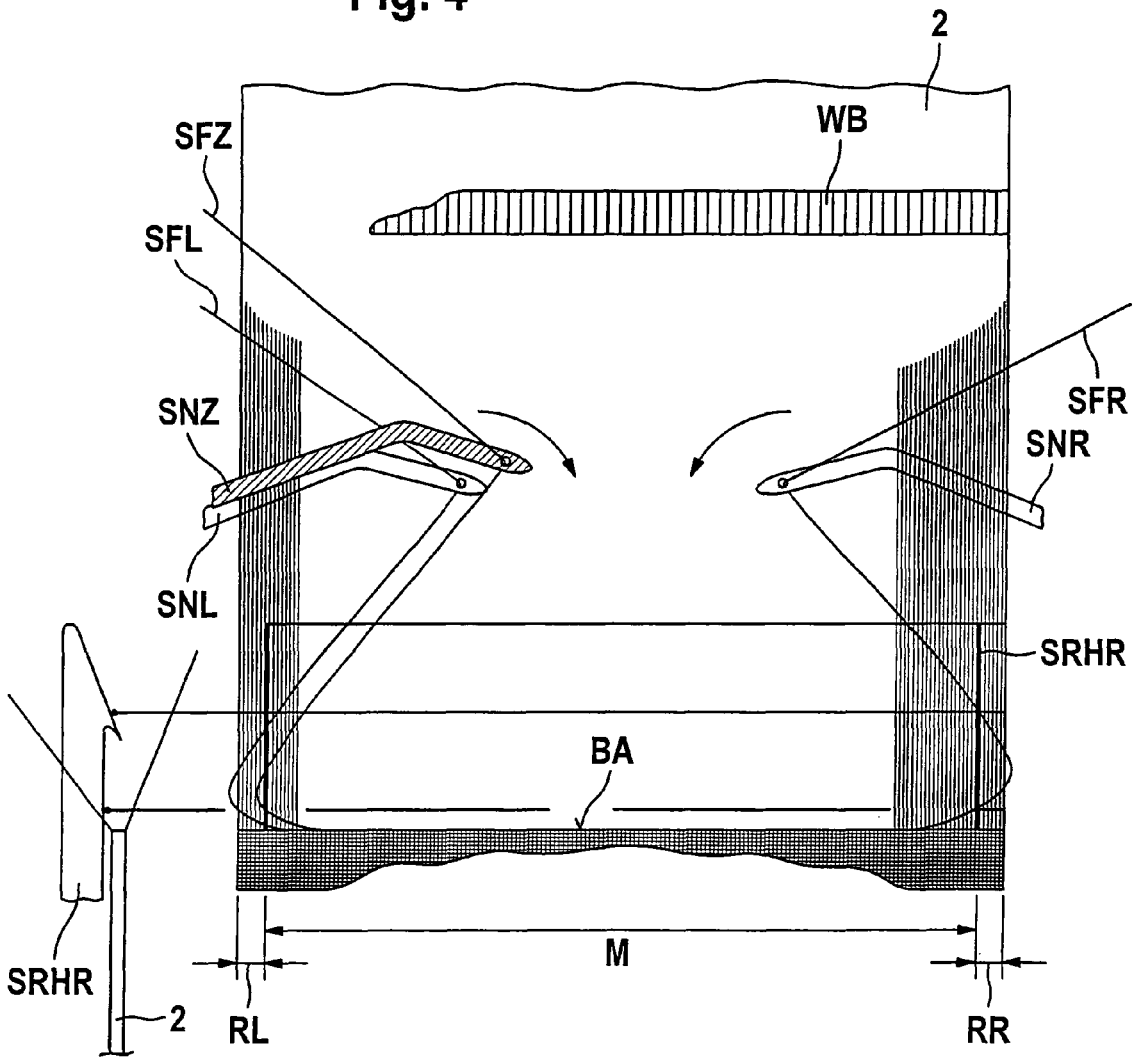
FIG. 4 is a view similar to that as shown in FIG. 1 but with an additionally employed monofil weft needle for picking a monofil thread.
Figure 5:
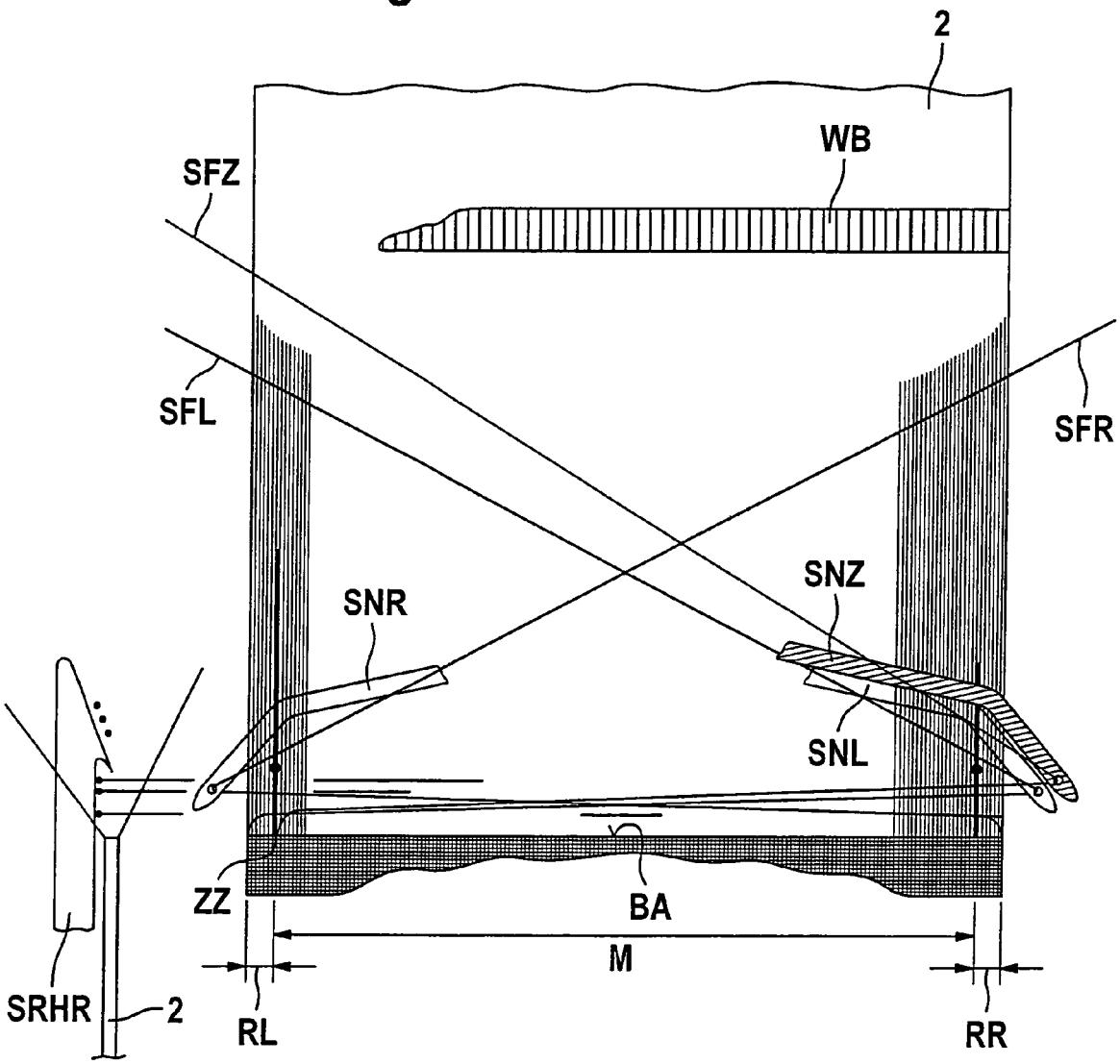
FIG. 5 is a view corresponding to that as shown in FIG. 2 but showing use of an additional monofil weft needle.
Figure 6:
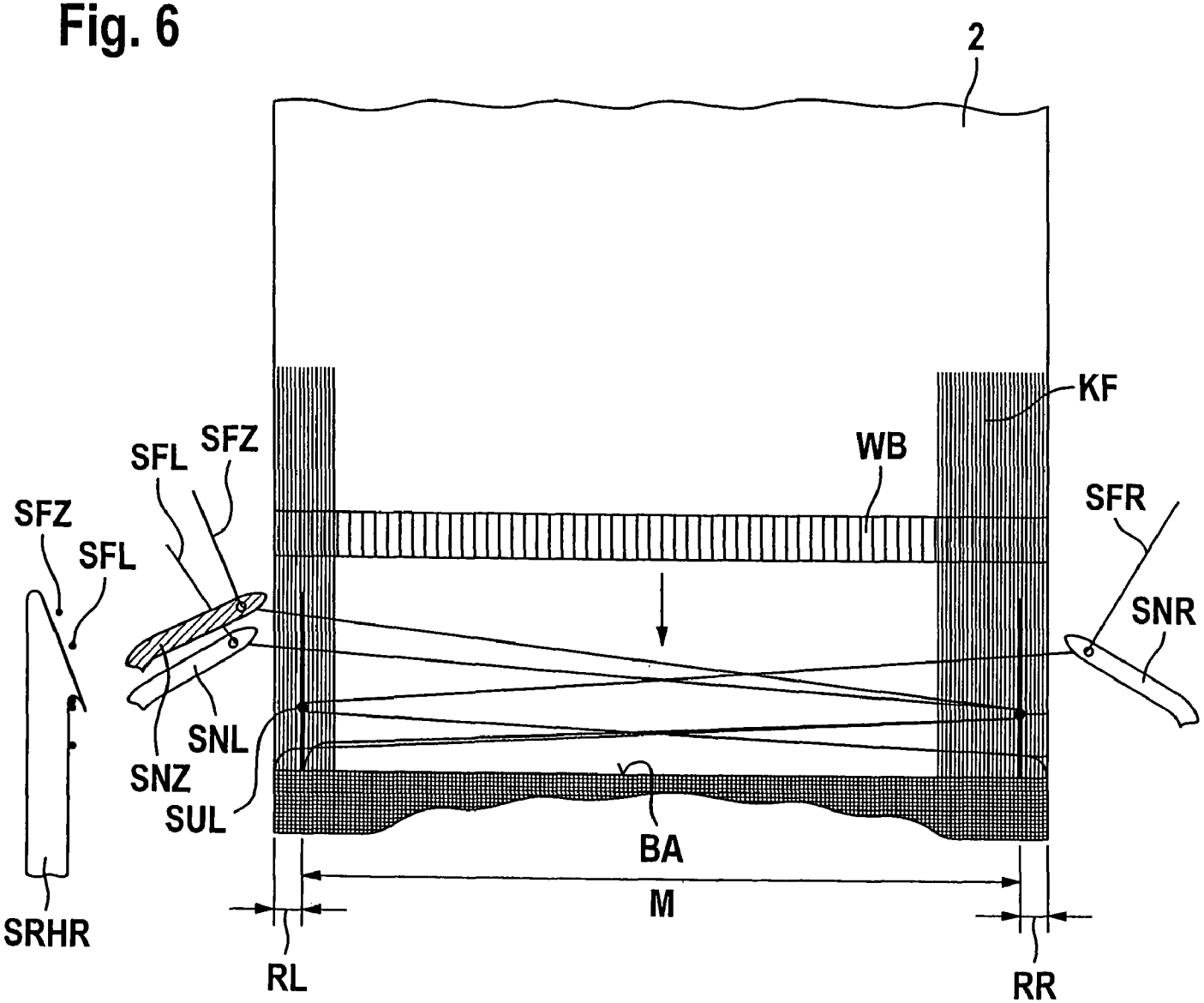
FIG. 6 is a view analogous to that as shown in FIG. 3 but showing use of an additional monofil weft needle.

Referring now to FIGS. 4 to 6 there is illustrated a step sequence analogous to that as shown in FIGS. 1 to 3 with the addition of an extra supplementary monofil weft needle SNZ being shown in the method and device highlighted shaded. Referring now to FIG. 6 particular indication is made to the two weft reversal points SUL on the left-hand side and SUR on the right-hand side, resulting from activation of the weft holdbacks SRHR and SRHL. Evident from FIG. 5 in the region of the transition between the inner portion and the left-hand edge portion at the selvedge of the already finish-woven material is a point ZZ intended as an example for feed of the supplementary thread (SFZ) by means of a heddle or similar means. When tracing the steps of the second example aspect of a weaving method in accordance with the invention in making use of a needle for an additional weft thread as shown in FIGS. 4 to 6, it is evident how as shown in FIG. 4 the weft needles have entered roughly by a third into the shed, FIG. 5 already showing the position of the weft needles after having fully penetrated the shed into the maximum retraction/end position. By contrast FIG. 6 shows the opposite maximum return position of the weft needles from the shed, the reed WB already being underway in a motion as indicated by the adjacent arrow to the already finished fabric or the weft threads in front thereof beaten up to the already finished material. In the next step the reed is again moved away from the fell and weft picking recommences from the start, resulting in the situation again as described in FIG. 4, and so on. To advantage the edge portions RL and RR are just 4 to 8 warp threads "wide" so that the additional thread is hidden from external view, i.e. invisible in the selvedge of the seat belt webbing.

By the ways and means as just described the method in accordance with the invention in its advantageous further embodiment comprises the following further steps:

az) picking a monofil weft thread SFZ fed preferably in the transition portion from the inner portion M to the left-hand edge portion RL from left to right up to the transition portion from the inner portion M to the right-hand edge portion RR by means of a left-hand supplementary weft needle SNZ simultaneously to step ar)

bz) retaining the monofil weft thread SFZ in the transition portion from the inner portion M to the right-hand edge portion RR by means of the right-hand weft holdback SRHR simultaneously to step cr), cz) tucking the monofil weft thread SFZ with the right-hand weft holdback SRHR and returning the right-hand weft holdback SRHR up to just before the fell BA simultaneously to the step cr)

dz) returning the left-hand supplementary weft needle SNZ simultaneously to step dr).

It is, of course, just as possible to replace this aspect of the device in accordance with the invention and of the correspond method using the left-hand supplementary weft needle SNZ by a right-hand additional weft needle or analogous simultaneously, the resulting situation then being mirror inverse or symmetrical. When there is sufficient room in the shed a variant involving two additional weft needles—one on the right and one on the left—can be made use of to advantage. In the methods as described hitherto the weft holdbacks SRHL, SRHR are shuttled on a light curve. In the forwards motion thereof—away from the fell—the weft threads advanced by the weft needles slide down into place behind the angled upright hook tips into the gussets of the hooks (see FIGS.).

Figure 7:
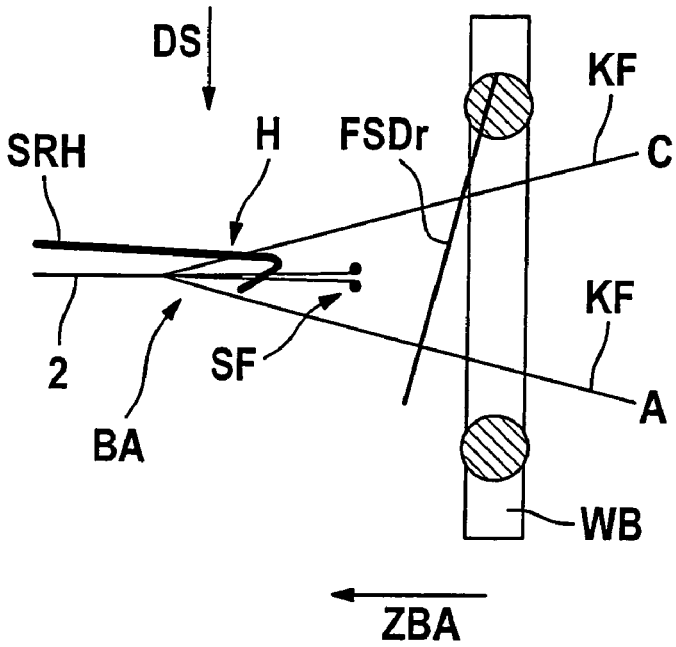
FIG. 7 is a greatly schematized view of a variant of a weft holdback fixedly secured to the loom and a reed moving thereon shown in the situation in which the weft needles are still located between reed and weft holdback, in a diagrammatic side view at an selvedge of the webbing.
Figure 8:
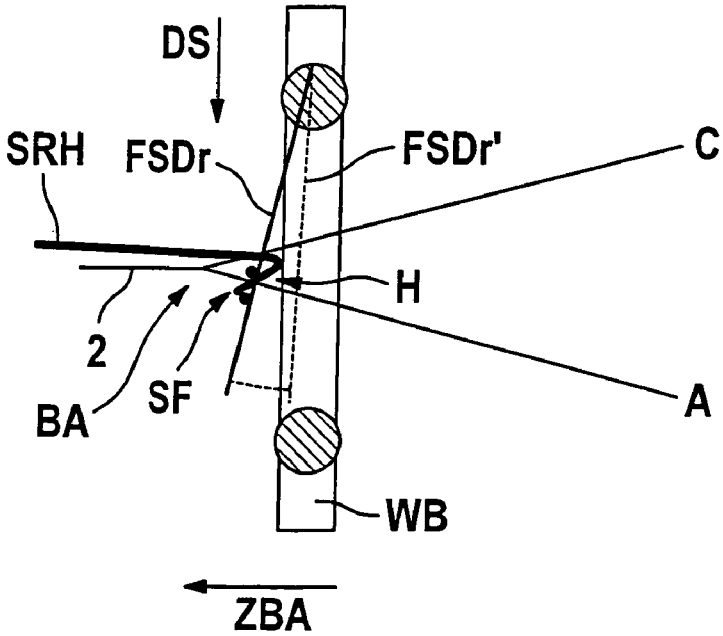
FIG. 8 is likewise a diagrammatic view as shown in FIG. 7 of the configuration as just described but here at a later point in time in which a stripper or holder wire is in contact with the weft loop to shift it to the fell.

Referring now to FIG. 7 there is illustrated as an example and strongly diagrammatic, i.e. simply qualitatively, how at the fell BA the webbing 2 opens into a shed A-C formed by the warp threads KF. A hook-shaped curved needle, in this case a weft holdback SRH, fixedly secured to the loom is provided in the vicinity of the fell BA whereby the reed WB is just about to move in the direction of the arrow ZBA to position the weft threads SF as shown in FIG. 8 just before the fell BA by means of the stripper/holder wires FSDr which in the position as shown in FIG. 8 is just before the fell BA, the stripper/holder wires FSDr having contacted the weft threads SF in the position of the reed WB as shown in FIG. 8. In further motion of the reed moving in the direction of the arrow ZBA it is elastically bent into the broken-line depicted position FSDr' in thereby stripping the weft threads SF from the hook H of the weft holdback SRH when the reed beats up the weft thread at the fell BA (thus, practically simultaneously).

Figure 9:
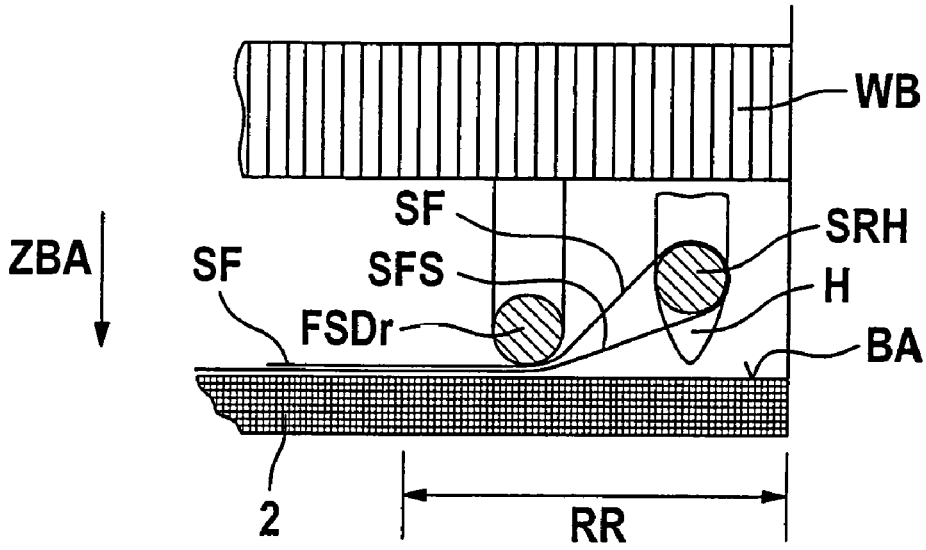
FIG. 9 is again a greatly magnified view of the situation as shown in FIG. 8 as viewed in the direction of the arrow DS of FIG. 8.

Referring now to FIG. 9 there is illustrated the situation as just described but now greatly magnified, showing just one selvedge of the seat belt webbing in accordance with the invention in conjunction with the sophistication of the present invention in accordance with the invention. The already finished-woven seat belt webbing 2 is evident from the lower portion in FIG. 9. A selvedge is represented by a right-hand edge RR. Clearly evident is the reed WB mounting the stripper/holder wires FSDr shown in part section urging the weft thread loops SFS of the weft threads SF wrapping the hook H of the weft holdback SRH against the fell BA. The arrow ZBA indicates motion of the reed as just completed.

Figure 10:
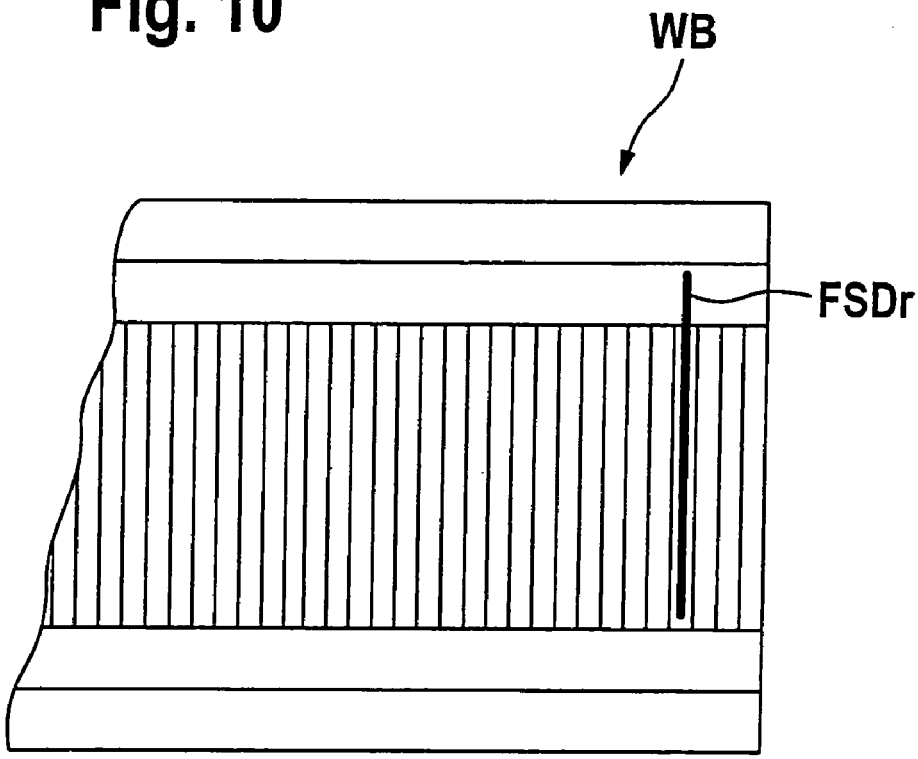
FIG. 10 is a view of the reed as shown in FIGS. 7 and 8 by way of an example including an example of how the stripper or holder wire is arranged.

Referring now to FIG. 10 there is illustrated diagrammatic a front view of the reed WB as viewed in a direction from left to right in a view as shown in FIG. 7. Clearly evident is the arrangement of the stripper/holder wire FSDr. It is emphasized that FIGS. 9 and 10 represent just sections of the right-hand edge portion of the seat belt webbing and, again, that there is no correlation between the dimensioning as shown in FIG. 9 and FIG. 10.

Figure 11:
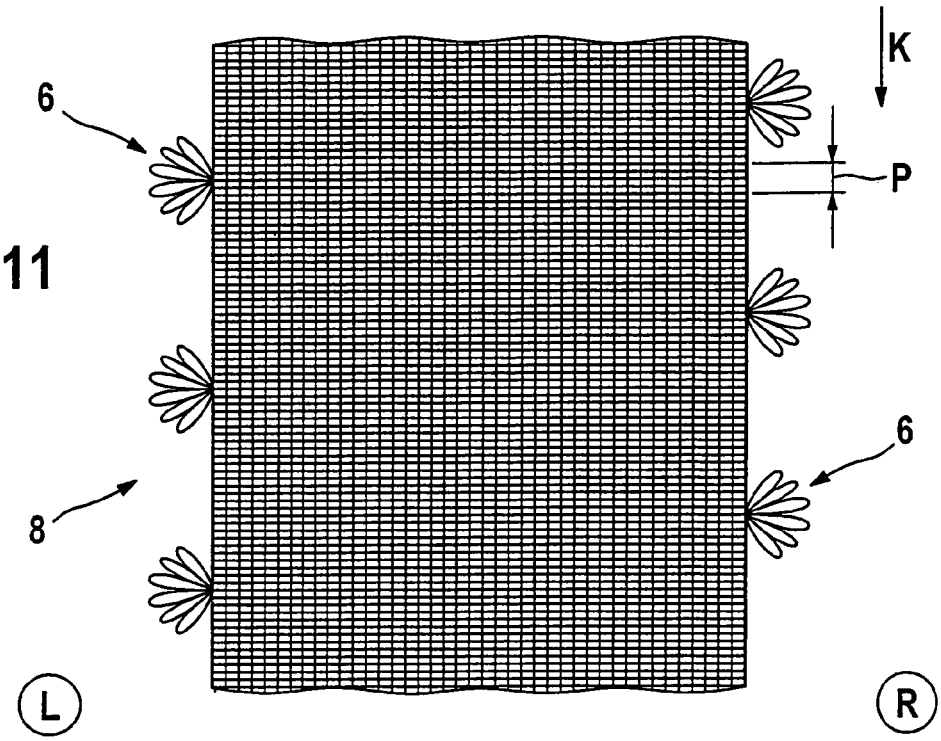
FIG. 11 is a diagrammatic top-down view of a webbing with picots at the edges.
Figure 12:
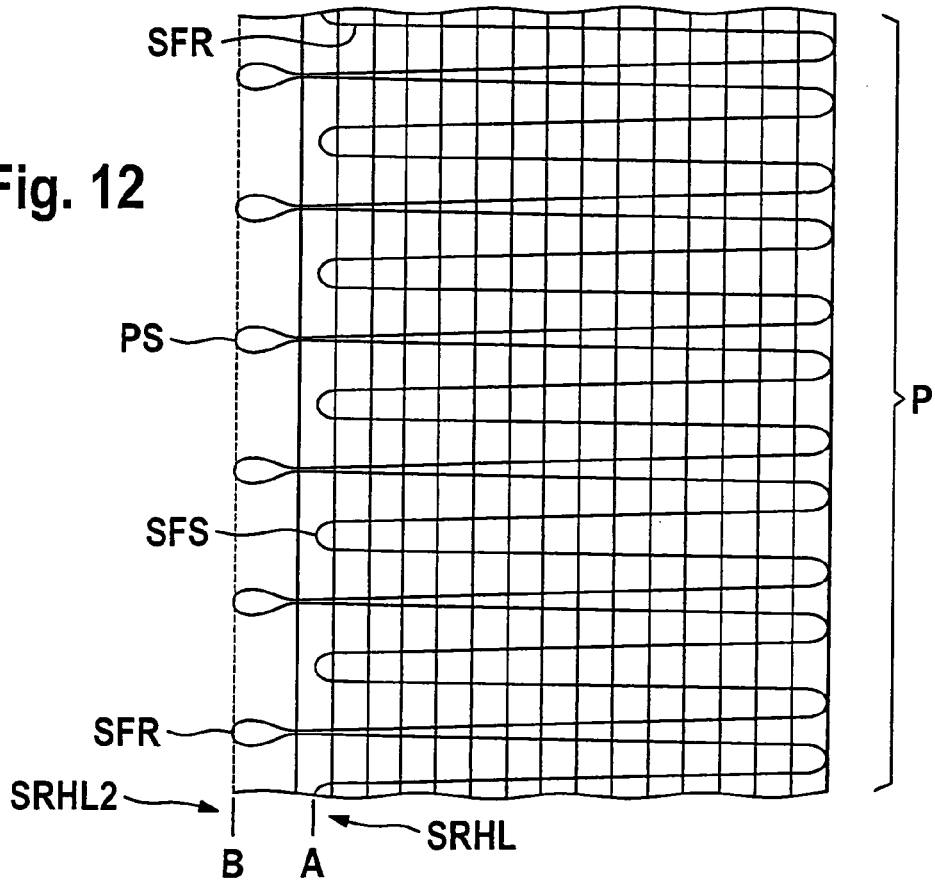
FIG. 12 is another diagrammatic top-down view of an exploded detail of the webbing as shown in FIG. 11 to highlight production of the picots at the selvedges.

Referring now to FIG. 11 there is illustrated very simplified diagrammatically the top-down view on a webbing 4 edged on both sides with picots 6. Highlighted in FIG. 11 is a portion P extending in the direction of the warp thread as indicated by the arrow K which is exploded in FIG. 12 to detail how a weft thread of a right-hand weft needle is guided in this portion. The weft holdbacks whose function and arrangement was detailed previously in the embodiment of FIGS. 11 and 12 are arranged in the positions A and B located transversely to the width of the webbing. The weft holdback in position A works like a weft holdback in the examples as already described, namely within the two edges of the webbing and serving to hold back the weft thread SFR picked to the left by the right-hand weft needle (not shown) resulting in it forming a weft thread loop within the webbing as shown in position A. As compared to the example aspects described hitherto a second left-hand weft holdback SRHL2 is additionally positioned at B as shown in FIGS. 11 and 12. This retains the (right-hand) weft thread SFR as picked by the (right-hand) weft needle (not shown) until the weft needle has been retracted from the shed back into its starting position in moving the reed WB (not shown) shortly before the end of the shed to the fell in thus setting the weft thread loop PS for the picot in the position B, i.e. protruding beyond the left-hand edge of the 4. Producing picots 6 at the right-hand selvedge of the webbing is done analogously to that as said above concerning the left-hand webbing selvedge.

It is emphasized that to simplify its overview FIG. 12 does not show the left-hand weft thread SFL picked from the left simultaneously. In effect, the configuration of the right-hand weft thread SFR merely shown qualitatively to illustrate diagrammatically the warp thread length portion P, as shown in FIG. 11, is understood to be bunched together in the warp direction, the train of a plurality of weft thread loops then resulting in the picot 6 and picot selvedge 8 respectively.

Figure 13:
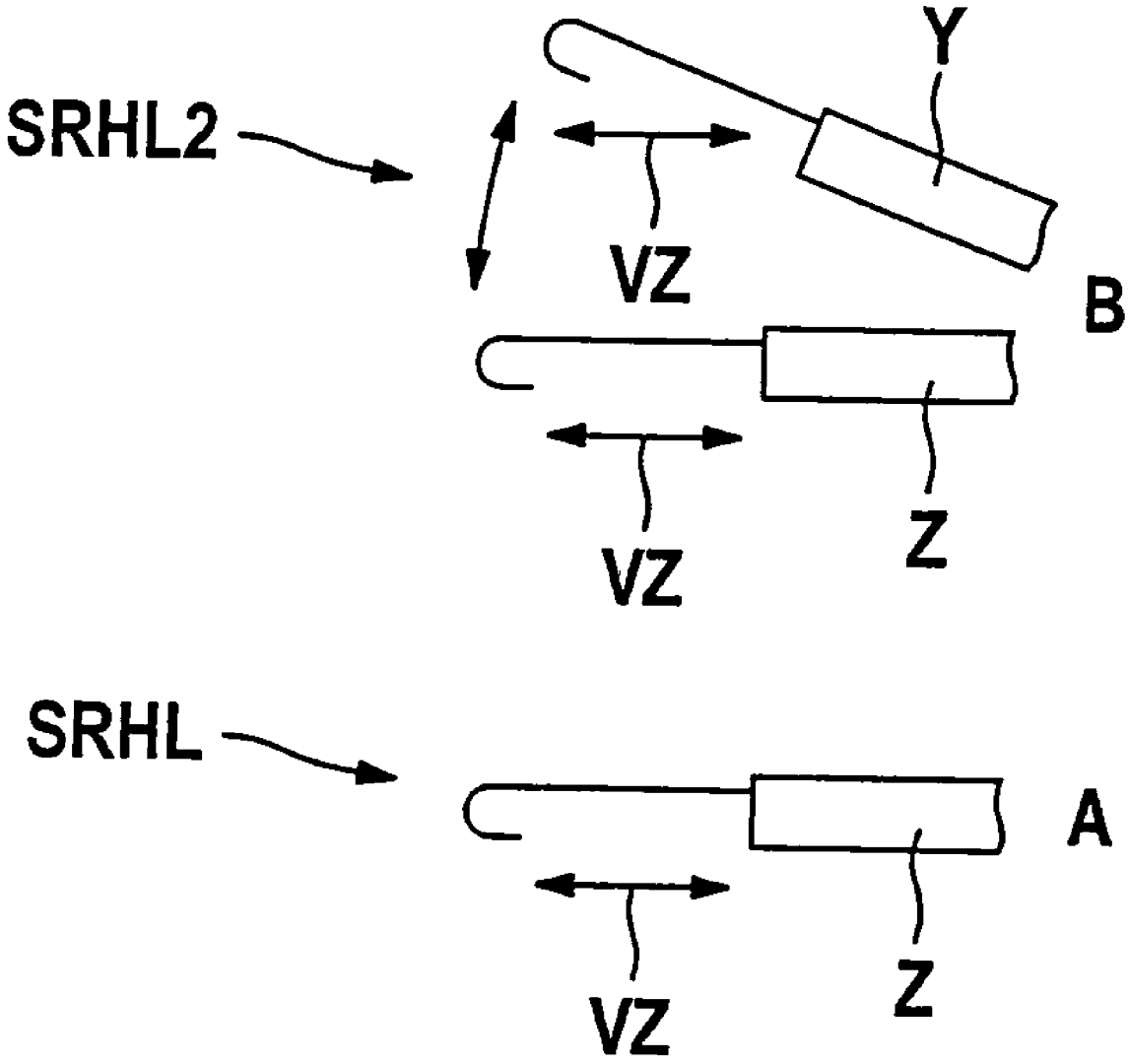
FIG. 13 is a diagrammatic side view of the weft holdback positions as employed in producing a webbing as shown in FIG. 11 and FIG. 12.

Referring now to FIG. 13 there is illustrated diagrammatically the two weft holdbacks as employed in the example aspects as shown in FIG. 11 and FIG. 12, i.e. weft holdback SRHL in the position A and weft holdback SRHL2 in position B located outside of the webbing 4 to be woven. The weft holdbacks are moved as indicated by the arrows VZ away from the fell BA and thereto. The weft holdback SRHL2 is also operated in two positions Y (up when no picots are produced) and Z (down when picots are produced). If in an advantageous further aspect of the invention more than one double weft thread is to be simultaneously picked per side preferably partly in differing sheds, then it is of advantage to control the up and down motion of the weft holdbacks precisely (analogous to FIG. 13, positions B: Y and Z) making it easier to tuck a stack of weft thread loops by the weft holdbacks.

Referring now to FIG. 14 there is illustrated a device in accordance with the invention for implementing a variant of the method in accordance with the invention in which the two weft threads SFL and SFR are picked by just one weft needle 28 (see FIG. 15 for details). In the region of its tip 34 the weft needle 28 has an eyelet 36 by means of which the first weft thread SFL is guided and shedded. Retracting the weft needle 28 from the shed results in a second (right-hand) weft thread SFR being tucked and shedded by means of a tucker 42 with a hook 40 which can be rotated into various locked positions.

Figure 16A:
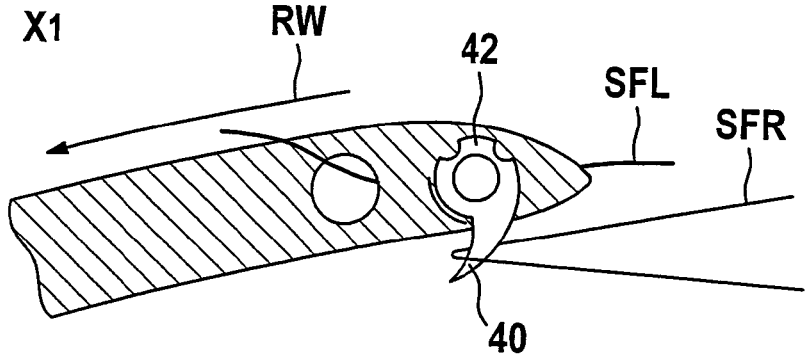
FIGS. 16*a* to 16*c* are each a diagrammatic partial section view of a magnified detail X as shown in FIG. 14 from the side view in three different states $X_1$ to $X_3$.
Figure 16B:
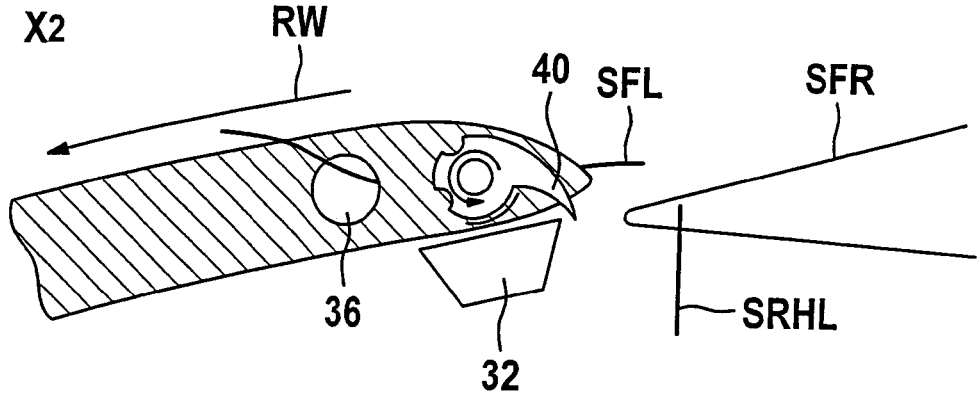
Figure 16C:
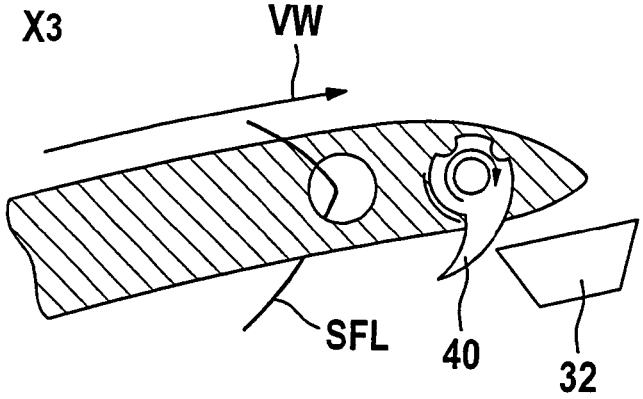

FIG. 14 shows the position—here greatly magnified to make for a simplified illustration—of the weft needle 28 in which it sheds the left-hand weft thread SFL, the hook 40 having already passed by the right-hand weft thread SFR. Referring now to FIG. 16 there is illustrated how a pusher 30 is provided to urge the weft thread SFR into the path taken by the hook 40 on return of the weft needle 28 as indicated by the arrow RW (FIGS. 16*a* and 16*b*). In this arrangement the right-hand weft thread SFR is entrained by the hook 40 (FIG. 16*a*) and guided by the weft needle 28 to beyond the left-hand weft holdback SRHL until the hook 40 by contacting in "overrunning" a stopper 32 fixedly mounted on the loom (see FIGS. 14, 16*b* and 16*c*) is turned against a spring latch 38 arranged in the weft needle 28 as shown by way of example in FIG. 15 to thereby "lose" the right-hand weft thread SFR (FIG. 16*b*), ending the pick cycle. The next pick cycle begins with the forwards motion of the weft needle 28 as indicated by the direction of the arrow VW as shown in FIG. 16*c*, here "overrunning" the stopper 32 fixedly connected to the loom (FIGS. 14, 16*b* and 16*c*)—but now in the opposite direction—causing the hook 40 to be repositioned for tucking.

The method as may be implemented, for example, by the device as shown in FIGS. 14 to 16*c* as set forth in claim 22 for weaving a webbing, particularly a seat belt webbing comprising an inner portion M, a soft right-hand edge portion RR and a soft left-hand edge portion RL is characterized by a continuous repeat of a step sequence;

sal) picking the left-hand weft thread SFL from the left-hand side of the webbing into the left-hand edge portion RL and into the inner portion M by means of the weft needle 28, sbl retaining the left-hand weft thread SFL in the transition portion from the inner portion M to the right-hand edge portion RR by means of a right-hand weft holdback SRHR, sr) tucking the right-hand weft thread SFR with the tucker 42, sar) picking the right-hand weft thread SFR from the right-hand side of the seat belt webbing into the right-hand edge portion RR and into the inner portion M by means of the weft needle 28, sbr) retaining the right-hand weft thread SFR in the transition portion from the inner portion M to the left-hand edge portion RL by means of a left-hand weft holdback SRHL, scr) tucking the right-hand weft thread SFR with the left-hand weft holdback SRHL and returning the left-hand weft holdback SRHL to the fell BA, scl) tucking the left-hand weft thread SFL with the right-hand weft holdback SRHR and returning the right-hand weft holdback SRHR to the fell BA particularly simultaneously to step cr), se) stripping off the weft loops formed in the previous step from the two weft holdbacks SRHL, SRHR by the reed WB to the fell BA and forwarding the two weft holdbacks away from the fell BA, f) beating up the two weft threads SFR, SFL by a reed WB.

It is emphasized that the method—as just described—can be implemented not just with one weft needle, variants thereof being possible with e.g. two dual weft needles the same or differing in length as well as in making use of further weft holdbacks as well as all combinations thereof. The person skilled in the art will readily appreciate that all selvedges known from prior art can be produced by the method in accordance with the invention.

In summary it is again pointed out that the invention now does away with the tuck and seal threads as well as the hardware therefor formerly always needed. As compared to prior art the invention provides a thinner webbing which especially with a softer selvedge makes for a great achievement as regards vehicular comfort. In addition to this, the webbing in accordance with the invention is more cost-effective in production than possible in prior art by saving steps in the method and components in the hardware involved. Furthermore, the present invention has the advantage that tensioning the weft thread is now substantially reduced in thus strongly diminishing the wear and tear and frequency of weft thread breakages and weft thread guide points. The knitting needles as needed in prior art and the fluffing associated therewith are now eliminated to advantage by the present invention.

LIST OF REFERENCE NUMERALS

2 seat belt webbing
4 webbing
6 picot
22 webbing
28 weft needle
30 pusher
23 stopper
34 needle tip
36 eyelet
28 spring latch
40 hook
42 tucker
A-C shed
BA fell
DS arrow
FSDr stripper/holder wires
FSDr' stripper/holder wires
H hook
KF warp threads
L (encircled) left-hand side
M inner portion
P picot portion
PS picot weft loop
R (encircled) right-hand side
RR right-hand edge portion
RL left-hand edge portion
SF weft thread
SFR right-hand weft thread
SFL left-hand weft thread
SFS weft thread loop
SFZ supplementary weft thread
SNR right-hand weft needle
SNL left-hand weft needle
SNZ left-hand supplementary weft needle
SRHL left-hand weft holdback
SRHL2 second left-hand weft holdback
SRHR right-hand weft holdback
SRHR2 second right-hand weft holdback
SUL left-hand weft reversal point
SUL right-hand weft reversal point
VX arrow
WB reed
Y weft thread holdback position
z weft thread holdback position
ZBA arrow

The invention claimed is:

1. A method for weaving a webbing, comprising picking at least one first (right-hand) weft thread and at least one second (left-hand) weft thread into the same shed from both sides of the webbing, looping at least the first and second weft threads around weft holdbacks in weft reversal loops, substantially holding back at least the first and second weft threads by the weft holdbacks until shed change, stripping at least the first and second weft threads off from the weft holdbacks by a reed after the shed change, and beating at least the first and second weft threads at a fell.

2. The method as set forth in claim 1, further comprising picking the first and second weft threads simultaneously into the same shed from both sides of the webbing.

3. The method as set forth in claim 1, further comprising creating weft loops or picots outside of the webbing adjoining at least one of the edge portions.

4. The method as set forth in claim 1, wherein the right-hand weft thread and left-hand weft thread are each a multifil thread.

5. The method as set forth in claim 1, wherein the right-hand weft thread and the left-hand weft thread are each a hybrid thread.

6. The method as set forth in claim 1, further comprising weaving with elastic warp threads.

7. The method as set forth in claim 1, further comprising picking the weft threads by just one weft needle which on entering shed guides and picks the first (left-hand) weft thread through an eyelet arranged in the region of a tip of the weft needle, and tucking the second (right-hand) weft thread on return of the weft needle from the shed by a tucker arranged at a tip and drawn into the shed.

8. The method as set forth in claim 1, further comprising creating a seat belt webbing including an inner portion, a soft right-hand edge portion and a soft left-hand edge portion, woven by a continuous repeat of the method further comprising:

(a) picking the left-hand weft thread from a left-hand side of the seat belt webbing into the left-hand edge portion and into the inner portion by a weft needle;

(b) retaining the left-hand weft thread in a transition portion from the inner portion to the right-hand edge portion by a right-hand weft holdback;

(c) tucking the right-hand weft thread with a tucker;

(d) picking the right-hand weft thread from a right-hand side of the seat belt webbing into the right-hand edge portion and into the inner portion by the weft needle;

(e) retaining the right-hand weft thread in the transition portion from the inner portion to the left-hand edge portion by a left-hand weft holdback;

(f) tucking the right-hand weft thread with the left-hand weft holdback and returning the left-hand weft holdback to the fell;

(g) tucking the left-hand weft thread with the right-hand weft holdback and returning the right-hand weft holdback to the fell particularly simultaneously with step (f), (h) stripping off weft loops formed in the previous step from the weft holdbacks by the reed to the fell and forwarding the two weft holdbacks away from the fell; and (i) beating up the two weft threads by the reed.

9. The method as set forth in claim 8, further comprising thermosetting the seat belt webbing, implemented after weaving, and the right and left-hand weft threads are hybrid threads.

10. The method as set forth in claim 7, further comprising weaving with elastic warp threads.

11. A method for weaving a seat belt webbing including a soft right-hand edge portion and a soft left-hand edge portion, the method comprising:

(a) picking a right-hand weft thread from a right-hand side of the webbing into a right-hand edge portion and into an inner portion by a right-hand weft needle;

(b) picking a left-hand weft thread from a left-hand side of the seat belt webbing into a left-hand edge portion and into the inner portion by a left-hand weft needle simultaneously with step (a);

(c) retaining the right-hand weft thread in a transition portion from the inner portion to the left-hand edge portion by a left-hand weft holdback;

(d) retaining the left-hand weft thread in the transition portion from the inner portion to the right-hand edge portion by a right-hand weft holdback simultaneously with step (c);

(e) tucking the right-hand weft thread with the left-hand weft holdback and returning the left-hand weft holdback to a fell;

(f) tucking the left-hand weft thread with the right-hand weft holdback and returning the right-hand weft holdback to the fell simultaneously with step (e);

(g) returning the right-hand weft needle to the right-hand side of the seat belt webbing;

(h) returning the left-hand weft needle to the left-hand side of the seat belt webbing simultaneously with step (e);

(i) stripping off weft loops formed in the previous step from the weft holdbacks by a reed to the fell and forwarding the weft holdbacks away from the fell; and (j) beating up the weft threads by the reed.

12. The method as set forth in claim 11, further comprising thermosetting the seat belt webbing, implemented after weaving, the right and left-hand weft threads being hybrid threads.

13. The method as set forth in claim 11, further comprising:

(k) picking a monofil weft thread fed preferably in the transition portion from the inner portion to the left-hand edge portion from left to right up to the transition portion from the inner portion to the right-hand edge portion by a left-hand supplementary weft needle simultaneously with step (a);

(l) retaining the monofil weft thread in the transition portion from the inner portion to the right-hand edge portion by the right-hand weft holdback simultaneously with step (c);

(m) tucking the monofil weft thread with the right-hand weft holdback and returning the right-hand weft holdback up to just before the fell simultaneously with step (e);

(n) returning the left-hand supplementary weft needle simultaneously with step (g).

14. The method as set forth in claim 11, further comprising the following second step sequence alternating with the first step sequence of steps (a)-(j), for optionally forming picots at the edge portions of the webbing:

(k) picking the right-hand weft thread from the right-hand side of the webbing over the full webbing width beyond the left-hand webbing side by a right-hand weft needle;

(l) picking the left-hand weft thread from the left-hand side of the webbing over the full webbing width beyond the right-hand webbing side by a left-hand weft needle, simultaneously with step (k);

(m) retaining the right-hand weft thread outside of the webbing adjoining the left-hand edge portion by a second left-hand weft holdback in forming weft loops;

(n) retaining the left-hand weft thread outside of the webbing adjoining the right-hand edge portion by a second right-hand weft holdback in forming weft loops simultaneously with step (m);

(o) returning the right-hand weft needle to the right-hand side of the webbing;

(p) returning the left-hand weft needle to the left-hand side of the webbing simultaneously with step (o);

(q) releasing the weft loops formed in the steps (m) and (n) from the second weft holdbacks; and (r) beating up the weft threads by a reed.

15. The method as set forth in claim 14, further comprising thermosetting the seat belt webbing, implemented after weaving, the right and left-hand weft threads being hybrid threads.

16. The method as set forth in claim 11, further comprising weaving with elastic warp threads.

17. A method for weaving fabric, the method comprising:

(a) inserting at least a first weft thread and a second weft thread simultaneously into the same shed, defined by warp threads, from both sides of the fabric;

(b) moving at least the first and second weft threads in substantially mirrored symmetry transversely across the fabric whereafter they are at least temporarily held back at the opposite side;

(c) winding at least the first and second weft threads around weft thread retainers; and (d) creating soft opposite edges of the fabric.

18. The method as set forth in claim 17, further comprising making the fabric with catch needle holders and the retainers, which are holdbacks, in a narrow fabric needle loom, but without tucking or crotcheting needles.

19. The method as set forth in claim 17, further comprising weaving a seat belt webbing from the fabric.

20. The method as set forth in claim 17, further comprising inserting an extra monofil weft thread with a supplementary needle along substantially the same weaving path as the adjacent first weft thread.

21. The method as set forth in claim 17, further comprising:

rotating a hook adjacent a tip of a weft needle, to selectively engage and disengage the first weft thread with the assistance of a pusher operably pushing the first weft thread; and moving the second weft thread extending through an eyelet in the needle when the needle simultaneously moves the first weft thread.

22. The method as set forth in claim 17, further comprising stripping off the first and second weft threads from the retainers, after shed change, by a reed extending across the fabric.

23. The method as set forth in claim 17, further comprising thermosetting the fabric.

24. The method as set forth in claim 17, further comprising weaving with elastic warp threads.

* * * * *